US006000461A

United States Patent [19]

Ross et al.

[11] Patent Number: 6,000,461

[45] Date of Patent: Dec. 14, 1999

[54] METHOD AND APPARATUS FOR CONTROLLED ATMOSPHERE BRAZING OF FOLDED TUBES

[75] Inventors: Gary R. Ross, Ann Arbor, Mich.; James R. Bacoccini, Toledo, Ohio

[73] Assignee: Livernois Research and Development Co., Dearborn, Mich.

[21] Appl. No.: 08/887,761

[22] Filed: Jul. 3, 1997

Related U.S. Application Data

[63] Continuation-in-part of application No. 08/822,161, Mar. 21, 1997.

[51] Int. Cl.[6] ..... F28D 1/053; F28F 9/16; B23P 15/26

[52] U.S. Cl. ..... 165/79; 165/133; 165/153; 165/173; 165/177; 165/183; 29/890.043; 29/890.053; 29/890.054; 138/115; 138/156

[58] Field of Search ..... 165/133, 177, 165/173, 183, 153, 79; 29/890.043, 890.053, 890.054; 138/115, 156

[56] References Cited

U.S. PATENT DOCUMENTS 4,241,727 12/1980 Toti ..... 138/156
4,825,941 5/1989 Hoshino et al. ..... 165/153 X
4,991,647 2/1991 Kawabe et al. ..... 165/905 X
5,579,837 12/1996 Yu et al. ..... 165/183
5,704,423 1/1998 Letrange ..... 165/177

FOREIGN PATENT DOCUMENTS 123571 5/1994 Japan ..... 165/177

*Primary Examiner*—Leonard Leo
*Attorney, Agent, or Firm*—Brooks & Kushman P.C.

[57] ABSTRACT

A heat exchanger (10) assembly with a first header (12), a second header (14), a plurality of seamed or folded type heat exchanger tubes (18) extending between the two headers (12, 14), and a plurality of heat exchanger fins (16). Each of the plurality of fins (16) has between 0.01% and 0.9% magnesium to improve the braze between the header (12, 14) and tube joint and the tube seam to inner surface joint (140). Additionally, the headers (12, 14) have a cladded inner surface with between about 0% to about 12.6% silicon to improve the braze at the tube-to-header joint.

19 Claims, 2 Drawing Sheets

Fig. 3
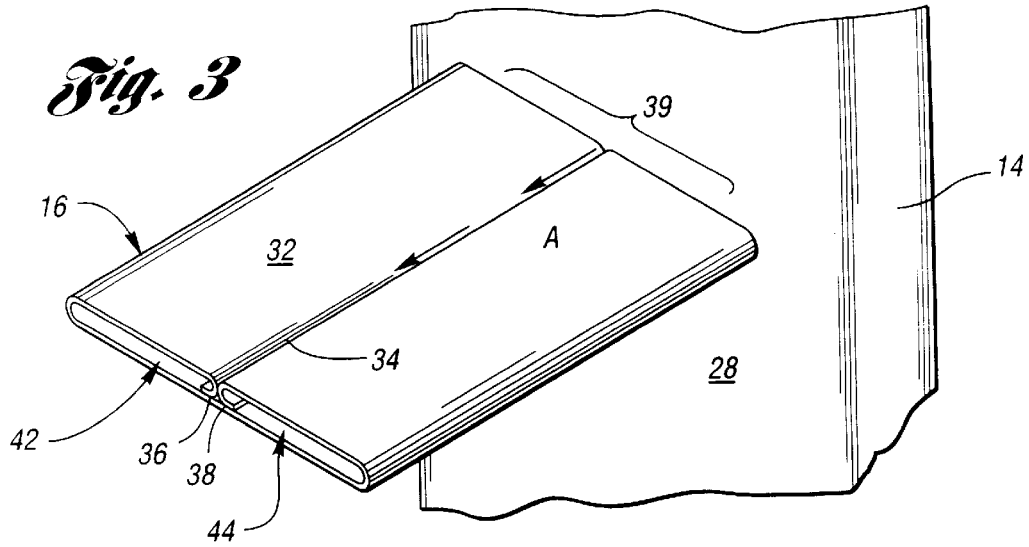
Fig. 4
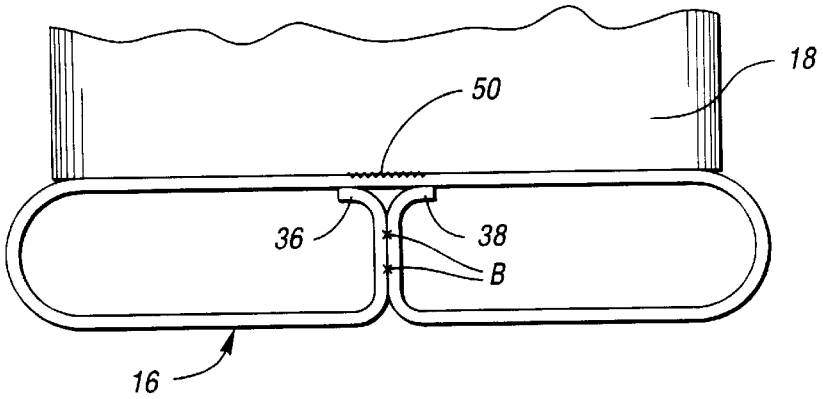
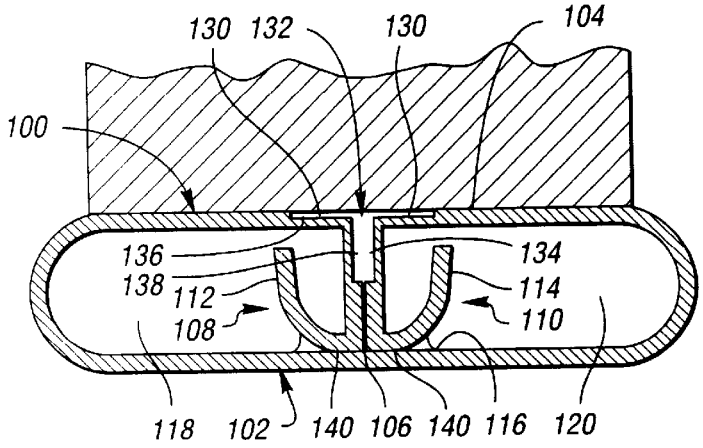
Fig. 5
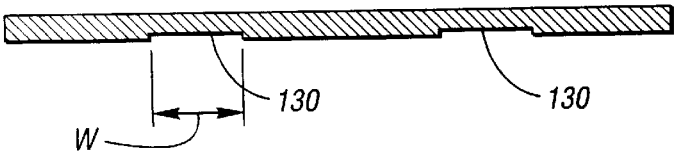
Fig. 6

METHOD AND APPARATUS FOR CONTROLLED ATMOSPHERE BRAZING OF FOLDED TUBES

CROSS REFERENCE TO RELATED APPLICATION

This application is a continuation-in-part of application Ser. No. 08/822,161, filed Mar. 21, 1997, and entitled "METHOD AND APPARATUS FOR CONTROLLED ATMOSPHERE BRAZING OF UNWELDED TUBES."

TECHNICAL FIELD

The present invention relates to a method and apparatus for manufacturing a heat transfer device.

BACKGROUND ART

Prior heat exchangers have included a plurality of round or oval tubes having a smooth or seamless surface that are typically formed by welding. These welded tubes have an unconstricted flow passage and are attached to a pair of headers to form a heat exchanger assembly. The tubes are joined to the headers by either vacuum brazing or controlled atmosphere brazing ("CAB"). Vacuum brazing and CAB are well known in the art.

Vacuum brazing is furnace brazing in a vacuum that eliminates the need for any flux. In operation, the assembly is heated in a furnace up to brazing temperature which takes about an average of 15 minutes. The assembly is then held at brazing temperature for about 1 minute and then quenched or air-cooled as necessary. Controlled atmosphere brazing ("CAB") is widely used for the production of high quality joints. CAB is not intended to perform the primary cleaning operation for the removal of oxides or other foreign materials from the parts to be brazed. Accordingly, fluxes are used with a controlled atmosphere to prevent the formation of oxides and to break up the oxide surface to make the surface more wettable.

These brazing techniques form a sufficiently strong bond between the headers and the prior round or oval tubes. Recently, folded-type or seamed tubes have been developed for use in heat exchangers. These tubes have a constricted flow passage. When the above described brazing techniques are applied to folded-type or seamed heat exchanger tubes, they yield a weak tube-to-header joint that can result in leakage of heat exchanger fluid or other failure of the heat exchanger apparatus under the combined influence of heat, vibration, and pulsating pressure. The primary cause of the weak tube-to-header joints is a poor fillet at the tube-to-header joint. Additionally, a poor fillet also occurs between the folded seam and inner surface of the tube. If the bond is weak at either of these locations, leakage of heat exchange fluid from the tubes results. The bond must also be strong if the heat exchangers are used in automobiles to withstand high vibrations, high temperatures, and long periods of use.

Various corrective techniques have been attempted to provide a better fillet at the tube-to-header joint and between the tube fold and tube inner surface. For example, elevating the brazing temperatures and increasing the brazing cycle times were two attempted techniques. However, these techniques removed even more cladded filler (fillet) from the surface of the headers, resulting in an even weaker tube-to-header bond.

Other corrective techniques included increasing the amount of clad on the outside of the folded-type tubes or using clad on the inside of the folded-type tubes. These techniques did not provide any appreciable increase in strength between the tube-to-header joint or tube fold to inner surface joint and only resulted in wasting the excess clad added to the tubes, resulting in increased cost.

Another technique included utilizing cladded fins in the heat exchanger. However, this also increased the cost without providing any appreciable change in the strength of the tube-to-header joint or tube fold to inner surface joint.

Another attempt to strengthen the bond at the tube-to-header joint and the tube fold to inner surface joint was to resize the tubes after assembly was completed. However, this also failed to provide any appreciable increase in strength of the tube-to-header joint or tube fold to inner surface joint. Thus, there has been no successful way to incorporate folded-type tubes into a heat exchanger assembly with a strong fillet at the tube-to-header joint or at the tube fold to inner surface joints.

SUMMARY OF THE INVENTION

It is an object of the present invention to provide a method and apparatus for increasing the strength of the bond between the heat exchanger tubes and headers by providing a reinforcing fillet at the tube-to-header joints.

It is yet another object of the present invention to provide a method and apparatus for increasing the strength of the bond between the tube fold and tube inner surface joints.

It is a further object of the present invention to provide a heat exchanger assembly that decreases the amount of capillary action and prevents excess clad from leaving the surfaces to be joined.

It is still a further object of the present invention to provide uncladded grooves and channels in the tube surface which tend to repel molten cladding.

The present invention provides a heat exchanger apparatus including a first header, a second header, a plurality of heat exchanger tubes, and a plurality of uncladded heat exchanger fins. The plurality of heat exchanger tubes are of a folded type and have a seam extending along an entire surface of each tube. The plurality of fins are located between a pair of heat exchanger tubes. The fins are comprised of an aluminum alloy containing between about 0.01% to about 0.9% magnesium to decrease the amount of capillary action and limit the amount of clad that is removed from the surface of the headers and tube by skiving, drilling or other known methods, to increase the wetability of the headers, and to provide a strong fillet at the surfaces to be joined. The amount of magnesium in the fins can be decreased to fall within the lower end of the range between 0.010% to about 0.9% because removing the surface of tubes to interrupt the flow of clad to the heat source requires less capillary-reducing magnesium from adjacent heated cladded surfaces, therefore, tending to pool molten cladding so that it is confined to the surfaces (e.g. fin/tube) to be joined.

The present invention also provides headers with a cladded surface. The clad or filler is comprised of an aluminum silicon mix, with a reduced amount of silicon, thus reducing the time and temperature of brazing at the tube-to-header joint and thus increasing the strength of the bond between the surfaces to be joined.

Additional features and advantages of the present invention will become apparent to one of skill in the art upon consideration of the following detailed description of the present invention.

BRIEF DESCRIPTION OF THE DRAWINGS

FIG. 3 is a schematic view illustrating the effect of capillary action that occurs at the tube-to-header joint;

FIG. 4 is a cross-sectional view illustrating the capillary action that occurs at the seam to inner surface joint;

FIG. 5 is a cross-sectional view of another embodiment of a folded heat exchanger tube in accordance with the present invention; and FIG. 6 is a sectional view illustrating a tube surface with two grooves formed by removing a superficial layer of cladding material in accordance with a preferred embodiment of the present invention.

BEST MODE FOR CARRYING OUT THE INVENTION

Figure 1:
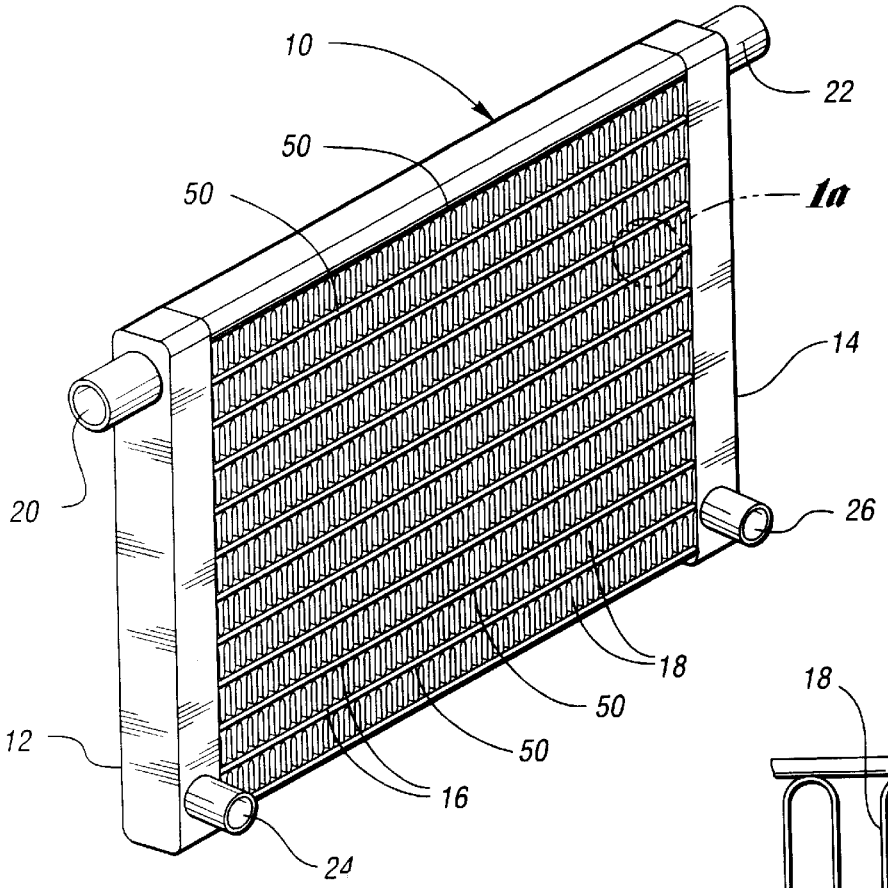
FIG. 1 is a perspective view of a heat exchanger apparatus in accordance with a preferred embodiment of the present invention.

FIG. 1 illustrates a heat exchanger assembly 10 in accordance with a preferred embodiment of the present invention. The heat exchanger assembly 10 includes a first header 12, a second header 14, a plurality of heat exchanger tubes 16 extending between the first header 12 and the second header 14, and a plurality of heat exchanger fins 16 with each fin positioned between and supporting a pair of cladded heat exchanger tubes 18. The heat exchanger assembly 10 also includes a first entrance opening 20 formed in the first header 12, a second entrance opening 22 formed in the second header 14, a first exit opening 24, formed in the first header 12, and a second exit opening 26 formed in the second header 14.

In operation, a heat exchange fluid, such as a coolant, flows into the plurality of heat exchanger tubes 16 through the entrance openings 20, 22 and contacts the heat exchange medium, such as warm air, passing through the assembly 10. The heat exchange fluid and the heat exchange medium effectuate a heat transfer, as is well known in the art, before the heat exchange fluid exits the assembly through exit openings 24, 26. It should be understood that the heat exchange fluid can be any warm or cold liquid or warm or cold gas. Similarly, the heat exchange medium can be either a warm or cold gas.

The various parts of the heat exchanger assembly 10 can be manufactured into a complete assembly by vacuum brazing, controlled atmosphere brazing or other conventionally available methods. However, the preferred method of manufacture is by controlled atmosphere brazing.

The first header 12 and the second header 14 have an inner surface 28 that has a layer of cladded filler (clad). The clad helps join the tubes 16 to the headers 12, 14. The clad on the headers 12, 14 is preferably an aluminum silicon alloy. Conventional aluminum silicon alloys are AA 4045 with a melting temperature between about 1070°–1110° F. However, the preferred embodiment has a lower amount of silicon such as AA 4343 with a melting temperature between about 1170° to 1135° F. It should be understood that these temperature ranges are only approximate and that these alloys can vary depending upon the application. During brazing, the clad on the surface headers 12, 14 is heated to a temperature where it liquifies and joins the tubes 16 to the headers 12, 14 to form an integral single part. In the preferred embodiment, the outside surfaces of the tubes 16 are also cladded. During brazing, the clad on the surfaces of the tubes 16 will liquify and join the folds of the tubes 16 to the tube inner surface.

In the preferred embodiment, both the headers and the tubes are comprised of an aluminum alloy that is approximately 98% pure. (In this disclosure, all percentages are in weight percent). Moreover, the clad is an aluminum silicon alloy, as disclosed above. The elements and percentage of the substrate and clad for a preferred embodiment are shown in the table below:

| | SUBSTRATE | CLAD |
|---|---|---|
| Al | 98–100% | 0–87.5% |
| Si | 0–.5% | 5.0–12.6% |
| Cu, Fe, Mg, Mn, Zn, Ti | Trace amounts which will vary depending upon the application. In some applications, one or more of these elements will not be present. | Trace amounts which will vary depending upon the application. In some applications, one or more of these elements will not be present. |

Additionally, other alloys may be used such as copper, iron, zinc, magnesium, manganese and titanium. Moreover, the percentages of each of these elements in the alloy may vary as the selection of the alloy and the elements depends upon the desired characteristics for the alloy. For example, the addition of titanium will increase the strength of the alloy while the addition of zinc will increase its corrosion resistance. Additionally, the headers can be of a different material than the tubes. Further, as the preferred temperature is dictated by the amount of silicon in the clad, the selection of the other elements and their percentages are selected in light of their effect on the melting point of the clad.

Figure 2:
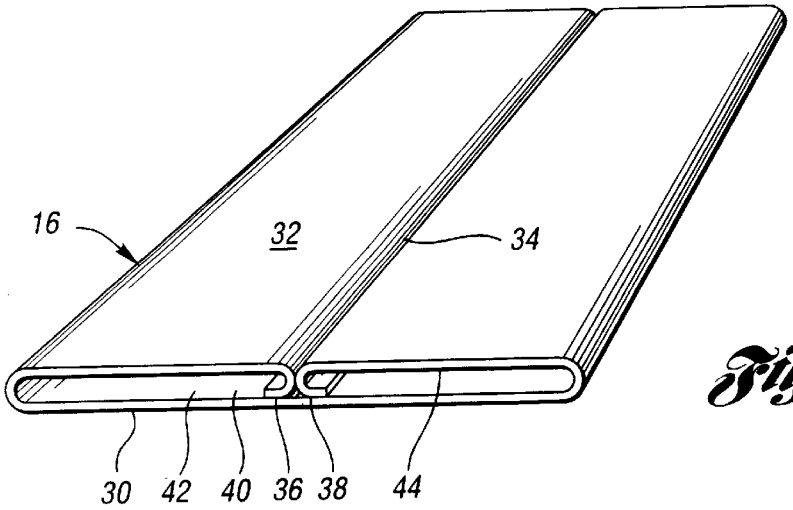
FIG. 2 is a perspective view of a folded heat exchanger tube in accordance with a preferred embodiment of the present invention.

FIG. 2 illustrates a folded-type or seamed heat exchanger tube 16 in accordance with a preferred embodiment of the present invention. The heat exchanger tubes 16 are preferably formed by folding. The resultant tubes 16 have a bottom surface 30 and a top surface 32. The top surface 32 has a seam 34 formed therein by preferably folding the ends 36, 38 of the metal sheet used to manufacture the tubes 16. The ends 36, 38 are folded into contact with the inner sides 40 of the bottom surfaces 30 of the tubes 16. Each tube 16 also has a pair of passageways 42, 44 formed therein through which the heat exchange fluid flows. The passageways 42, 44 have a generally constricted cross-section. The outer surface, including the top surface 32 and the bottom surface 30 of each of the tubes 16 is cladded. The clad on the tubes is an aluminum-silicon alloy, preferably with the same composition as the clad on the headers 12, 14.

FIG. 3 is a schematic illustration of a heat exchanger tube-to-header joint 39. As discussed above, when heat exchangers with folded tubes are brazed, a weaker tube-to-header joint is formed with the seamed tubes than with heat exchangers with seamless tubes. It has been discovered that this is due to a number of causes. One reason for the weak bond is that the seam 34 in the tubes allows for capillary action of the clad. Capillary action is the effect of the clad on the outer surface 28 of the headers 12, 14 liquefying and traveling along the folded seam 34 in the top surface 32 of the tubes 16 (as shown by the arrows A) and away from the joints needed to be bonded. The clad will liquify when the base material is heated to a certain temperature. If enough clad is removed from the headers 12, 14, the tubes 16 will not be effectively seamed to the headers 12, 14. Capillary action occurs because after the clad liquifies, it travels to the source of greatest heat, which is the center of the core. Accordingly, a sound fillet joining the heat exchanger tubes to the headers is not formed.

Figure 1A:
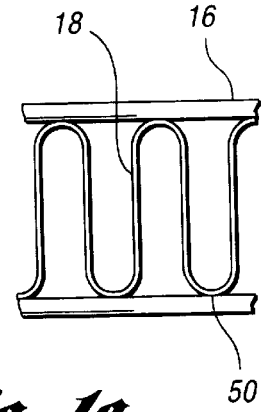
FIG. 1*a* is an enlarged sectional view of the circled portion of FIG. 1.

It has been discovered that the liquid clad is also being pulled from the tubes 16 to the fin fillet joint 50 (FIGS. 1*a*, 4) on the top or seam side 32 of the heat exchanger tubes 16. The clad wants to travel to this contact area between the tubes 16 and fins 18 because the fins heat up quicker than the tubes since they are thinner and may have different metallurgical compositions than the tubes. Accordingly, these heat sources pull the clad material off the headers 12, 14 and through capillary action form fillets at the tube-to-fin contact area 50 on the seam side 32 of the tubes 16, as shown in FIG. 5. This results in a poor fillet at the tube-to-header joint 39, as well as a poor fillet at the end 36, 38 to inner surface 40 joint. In order to stop the flow of clad to the fins 16, heat transfer between the tubes 16 and fins 18 needs to be reduced. By reducing this heat transfer, the flow of clad from the headers to the tubes and then to the fins through capillary action is prevented.

In order to prevent the forming of these fillets on the tube-to-fin contact area 50, the fins 16 are manufactured from an aluminum alloy with about 0.01% to about 0.90% of magnesium. Through experimentation, it has been determined that less than 0.01% of magnesium will not significantly increase the strength of the tube to inner seam bonds. Additionally, more than 0.9% magnesium is overkill and unnecessary. However, the scope of this disclosure is not intended to preclude fins with more than 0.9% magnesium.

It has been discovered that magnesium in the fins 18 makes the contact area 50 between the fin and the tubes less wettable and thus harder to braze. Accordingly, a magnesium alloy in the fins will minimize the fillet on the tube-to-fin area 50, while at the same time, maximizing the fillet on the tube-to-header joint 39, as well as on the tube seam to inner surface joint 36, 38.

Fins are typically manufactured with 0% magnesium if the heat exchanger is to be brazed by controlled atmosphere brazing. For fins that have been brazed by vacuum brazing, they typically contain between 1–2% magnesium. Thus, in accordance with the preferred embodiment of the present invention, if the assembly is to be brazed by CAB, magnesium is added to the fins such that the amount of magnesium is within the desired range. If the assembly is to be brazed by vacuum brazing, magnesium is preferably removed from the fins. However, more than 0.9% magnesium may be used, but it increases the cost of manufacture and decreases its corrosion resistance. The fins are preferably uncladded because clad on the fins does not add significant additional bonding strength when compared to the cost. However, cladded fins may be incorporated into the disclosed heat exchanger.

The above percentages of magnesium are determined by the overall matrix size of the assembly as well as the fin weight per inch, the desired fillet size (fillet-to-tube), and the time and temperature of brazing. Thus, the percentage of magnesium in the fins will vary. Using increased amounts of magnesium in the base fin material causes a blocking action in the fin fillet as the size of the fillet is controlled by the amount of magnesium used.

Additionally, it has also been determined that the header-to-tube bond can be further improved by reducing the amount of silicon used in the clad on the header inner surface 28. The silicon causes the clad on the inner surface 28 of the headers 12, 14 to liquify at lower temperatures than the aluminum. Moreover, if some of the silicon is removed, a higher temperature is needed before the clad will liquify and form the bond. This prevents the filler material (clad) on the header 12, 14 from becoming a liquid before the clad on the tubes 16 becomes a liquid. Thus, the cladded tubes will come up to brazing temperature before the clad on the header surfaces 28. This will also minimize the amount of capillary action and increase the strength of the bond between the tubes and the header. The amount of silicon in the clad on the header surface 28 can range from between about 0% to about 12.6%, but is preferably between about 9.0% and about 11.0%. Additionally, reducing the amount of silicon in the clad will also reduce the cost of manufacturing the assembly. If the amount of silicon is above about 12.6%, the clad on the headers will liquify at lower temperatures than the clad on the tubes.

FIGS. 5 and 6 illustrate another embodiment of a folded type heat exchanger tube 100 in accordance with the present invention. The individual folded type tube 100 shown in the figures is just one of a plurality of tubes that is incorporated into a heat exchanger assembly in the same way as discussed above. The folded tube 100 has a bottom surface 102 and a top surface 104. The top surface 104 has a seam 106 formed therein by folding the ends or edges 108, 110 of the cladded metal sheet used to manufacture the tubes 100. The ends 108, 110 of the tubes 100 each have respective flanges 112, 114 that are folded or bent generally inwardly and upwardly. A portion of each of the ends 108, 110 of the tubes 100 contacts the inner side 116 of the bottom surface 102 of the tube 100 to form a joint therebetween. Each tube 100 has a pair of passageways 118, 120 formed therein through which the heat exchange fluid flows. The passageways 118, 120 each have a generally constricted cross-section. General methods for manipulation of a metal sheet and folding are well known in the art.

The outside surfaces of the tube 100 are preferably cladded, as discussed above. As best shown in the embodiment of FIG. 6, the outside surface of the tube 100 has a plurality of grooves 130 formed therein. The grooves 130 are preferably formed by skiving, or equivalent steps which occur by removing out the clad from a section of the tube. It should be understood that the grooves 130 can be formed by cutting, chiseling, milling or other known methods. The amount of clad that is removed and thus the depth of the grooves 130 depends upon the thickness of the tubes 100 and the amount of clad applied to the surface. By way of example, in one embodiment in accordance with the present invention, the thickness of the tubes is 0.01250 inches and the clad on the tube surface is 12.5% of the over-all thickness of the tube or about 0.00157 inches. The depth of the grooves 130 is then formed by removing the clad from the tube surface where the grooves are to be formed. The skiving of the clad from the tube surface (or other operation for removing the clad) makes the surface more wettable. Thus, the uncladded surface will not braze and the clad will not flow from one side of the groove 130 to the other because they are denuded of cladding and the bare (uncladded) substrate tends to repel the molten cladding.

The purpose of skiving or groove formation is to break or block the flow of clad (filler) material from the tubes to the headers and from the tube seam to the fin fillets by use of a T-shaped gap 132 defined by the groove 130 and the channel 134. The clad will not jump these gaps or grooves, Hence, the flow of clad to the heat source is interrupted and capillary action is reduced without the need to add unnecessary magnesium in the fins.

As shown in FIG. 5, the grooves 130 are formed in the tubes such that each groove 130 has a first portion 136 which is located in the top surface and forms part of the upper part of the T-shaped gap 132 and a second portion 138 which is located on the end portions 108, end portions 110 on the stem of the T-shaped gap 132. The grooves 130 are thus formed so that they span the seam 106 of the tubes 130 in order to help inhibit any capillary action. If the groove 130 is not wide enough, the uncladded surface could braze and allow the clad to flow from one side of the groove 130 to the other. In the preferred embodiment, the groove is 0.05 inches wide. However, it may be more or less so long as the flow of clad is interrupted. The grooves 130 provide an interrupt, so that the clad on the outside of the tubes 130 will form a strong fillet at joint 140. This provides a strong leak-free tube, because the clad will not be able to travel across the grooves 130 to the tube fin joint.

By reducing the amount of capillary action, the amount or percentage of magnesium in the fins can be reduced in this embodiment. The amount of magnesium used is thus preferably in the lower half of the 0.01% to 0.9% range. This adds the advantage of minimizing any corrosion of the fins that may occur as a result of the inclusion of magnesium. This will also reduce the cost manufacturing the fins. It should be understood that the number of grooves may vary as necessary, as can its dimensions.

While only one preferred embodiment of the invention has been described hereinabove, those of ordinary skill in the art will recognize that this embodiment may be modified and altered without departing from the central spirit and scope of the invention. Thus, the embodiment described hereinabove is to be considered in all respects as illustrative and not restrictive, the scope of the invention being indicated by the appended claims, rather than by the foregoing descriptions, and all changes which come within the meaning and range of equivalency of the claims are intended to be embraced herein.

What is claimed is:

1. A method for manufacturing a heat transfer device, comprising:

providing a plurality of heat transfer tubes, each having a first and a second end and a generally T-shaped groove defined by a plurality of grooves formed in an outside surface by removing a layer from said top surface at select locations;

providing a first header for attachment to said first end of said plurality of heat transfer tubes, said header having an inner surface;

providing a second header for attachment to said second end of said plurality of heat transfer tubes, said header having an inner surface;

providing a plurality of heat transfer fins with one of said plurality of heat transfer fins being positioned between two of said plurality of heat transfer tubes; and brazing said plurality of heat transfer tubers, said first header, said second header, and said plurality of heat transfer fins to provide a header joint with a fillet at the joint where said first and second ends of said plurality of heat transfers tubes attach to said first and second headers, respectively.

2. The method of claim 1, wherein said heat transfer device is a heat exchanger.

3. The method of claim 2, wherein said heat exchanger is a radiator for use in an automobile.

4. The method of claim 1, wherein said plurality of heat transfer fins have between by weight about 0.01% and about 0.9% magnesium.

5. The method of claim 1, wherein both said cladded inner surfaces of said first and second headers include clad with between by weight about 0% and about 12.6% silicon.

6. The method of claim 1, wherein said plurality of heat transfer tubes are formed of an aluminum alloy.

7. The method of claim 1, wherein said brazing step comprises controlled atmosphere brazing.

8. The method of claim 1, wherein said plurality of heat transfer tubes are folded-type tubes.

9. The method of claim 1 wherein the step of providing a plurality of heat transfer tubes comprises:

providing a strip of material, the strip having edges and a base layer and a cladded layer juxtaposed thereto;

forming a plurality of generally U-shaped grooves parallel to the length of the strip, the grooves being formed by removing a portion of the cladding layer so that an uncladded surface is exposed within each groove;

folding the edges of the strip inwardly towards each other so that a pair of U-shaped grooves unite to form the generally T-shaped groove disposed on an outside surface of the tube so that flow of molten cladding away from the tubes to the headers and tube seams to fin fillets is retarded.

10. A method for manufacturing a folded-type heat exchanger tube, comprising:

providing a metal strip having a top surface and a bottom surface and a first edge and a second edge;

forming a plurality of generally U-shaped grooves in said top surface of said metal strip in predetermined locations; and folding said metal strip into a heat exchanger tube having a seamless bottom surface, a seamed top surface defined by folding said first edge and said second edge inwardly toward and into contact with said inner surface with the U-shaped grooves becoming juxtapositioned to define a T-shaped groove.

11. The method of manufacturing a folded-type heat exchanger tube of claim 10, wherein said forming step comprises skiving.

12. The method for manufacturing a folded type heat exchanger tube of claim 10, wherein said forming step comprises cutting.

13. The method for manufacturing a folded type heat exchanger tube of claim 10, wherein said grooves formed in said top surface have a first portion and a second portion.

14. The method for manufacturing a folded-type heat exchanger tube of claim 13, wherein said first portion of said groove is located on said top surface of said tube after folding and said second portion of said groove extends generally downwardly away from said top surface after folding.

15. A heat exchanger assembly comprising:

a first header;

a second header;

a plurality of cladded seamed heat exchanger tubes each having a first end for attachment to said first header and a second end for attachment to said second header; and a plurality of T-shaped grooves from which cladding has been removed formed at the seam of each of said plurality of heat exchanger tubes to limit the flow of clad away from the tubes to the headers and tube seams to fin fillets; and a plurality of heat exchanger fins with each of said fins being positioned between a respective pair of said plurality of seamed heat exchanger tubes.

16. The heat exchanger assembly of claim 15, wherein said first header is attached to said first end of said heat exchanger tubes and said second header is attached to said second end of said heat exchanger tubes by controlled atmosphere brazing.

17. The heat exchanger assembly of claim 15, wherein said first header is attached to said first end of said heat exchanger tubes and said second header is attached to said second end of said heat exchanger tubes by vacuum brazing.

18. The heat exchanger assembly of claim 15, wherein said first header and said second header have between by weight about 0% to about 12.6% silicon.

19. The heat exchanger assembly of claim 14, wherein each of said plurality of heat exchanger fins is comprised of an aluminum alloy having by weight between 0.01% and about 0.9% magnesium.

* * * * *